US009347160B2

(12) United States Patent
Maki

(10) Patent No.: US 9,347,160 B2
(45) Date of Patent: May 24, 2016

(54) SEWING MACHINE AND NON-TRANSITORY COMPUTER-READABLE MEDIUM STORING SEWING MACHINE CONTROL PROGRAM

(71) Applicant: BROTHER KOGYO KABUSHIKI KAISHA, Nagoya-shi, Aichi-ken (JP)

(72) Inventor: Ryutaro Maki, Handa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/515,991

(22) Filed: Oct. 16, 2014

(65) Prior Publication Data

US 2015/0122165 A1 May 7, 2015

(30) Foreign Application Priority Data

Nov. 7, 2013 (JP) ..... 2013-231171

(51) Int. Cl.
*D05B 19/12* (2006.01)
*D05B 81/00* (2006.01)

(52) U.S. Cl.
CPC ..... *D05B 19/12* (2013.01); *D05B 81/00* (2013.01)

(58) Field of Classification Search
CPC ..... D05B 19/12; D05B 19/14
USPC ..... 700/136–138
See application file for complete search history.

(56) References Cited

U.S. PATENT DOCUMENTS 4,552,080 A 11/1985 Miyazaki
4,702,185 A * 10/1987 Hanyu ..... D05B 47/04 112/254
5,826,526 A * 10/1998 Tomita ..... D05B 19/12 112/102.5
7,280,886 B2 * 10/2007 Iida ..... D05B 65/06 700/136
7,308,333 B2 * 12/2007 Kern ..... D05B 19/12 112/254
8,463,420 B2 * 6/2013 Tokura ..... D05B 19/12 112/102.5
8,527,083 B2 * 9/2013 Tokura ..... D05B 19/10 112/102.5
2004/0221780 A1 11/2004 Kawaguchi et al.
2015/0090168 A1 * 4/2015 Kobayashi ..... D05B 19/12 112/470.03
2015/0122165 A1 * 5/2015 Maki ..... D05B 81/00 112/470.05

FOREIGN PATENT DOCUMENTS

JP A-58-190494 11/1983
JP A-04-105690 4/1992
JP A-09-217261 8/1997
JP A-2004-254987 9/2004
JP A-2006-087813 4/2006

* cited by examiner

*Primary Examiner* — Danny Worrell
(74) *Attorney, Agent, or Firm* — Oliff PLC

(57) ABSTRACT

A sewing machine includes a cloth thickness detection device, a storage device, and a control device. The cloth thickness detection device detects a cloth thickness of a work cloth. The storage device stores cut data that include a plurality of needle drop points for a cutting needle. The control device modifies a distance between adjacent ones of the needle drop points in the cut data in accordance with the cloth thickness that has been detected by the cloth thickness detection device. Then control device performs cut work on the work cloth using the cutting needle, in accordance with the cut data in which the distance between the adjacent needle drop points has been modified.

9 Claims, 12 Drawing Sheets

FIG. 6

98

| NEEDLE DROP POINT NUMBER | NEEDLE DROP POINT | CUTTING EDGE DIRECTION |
|---|---|---|
| P1 | (0, 0) | 90° |
| P2 | (0, -2) | 90° |
| P3 | (0, -2) | 90° |
| P4 | (0, -2) | 90° |
| P5 | (0, -2) | 90° |
| P6 | (0, -2) | 90° |
| P7 | (0, -2) | 0° |
| P8 | (2, 0) | 0° |
| ⋮ | ⋮ | ⋮ |
| P32 | (-2, 0) | 0° |

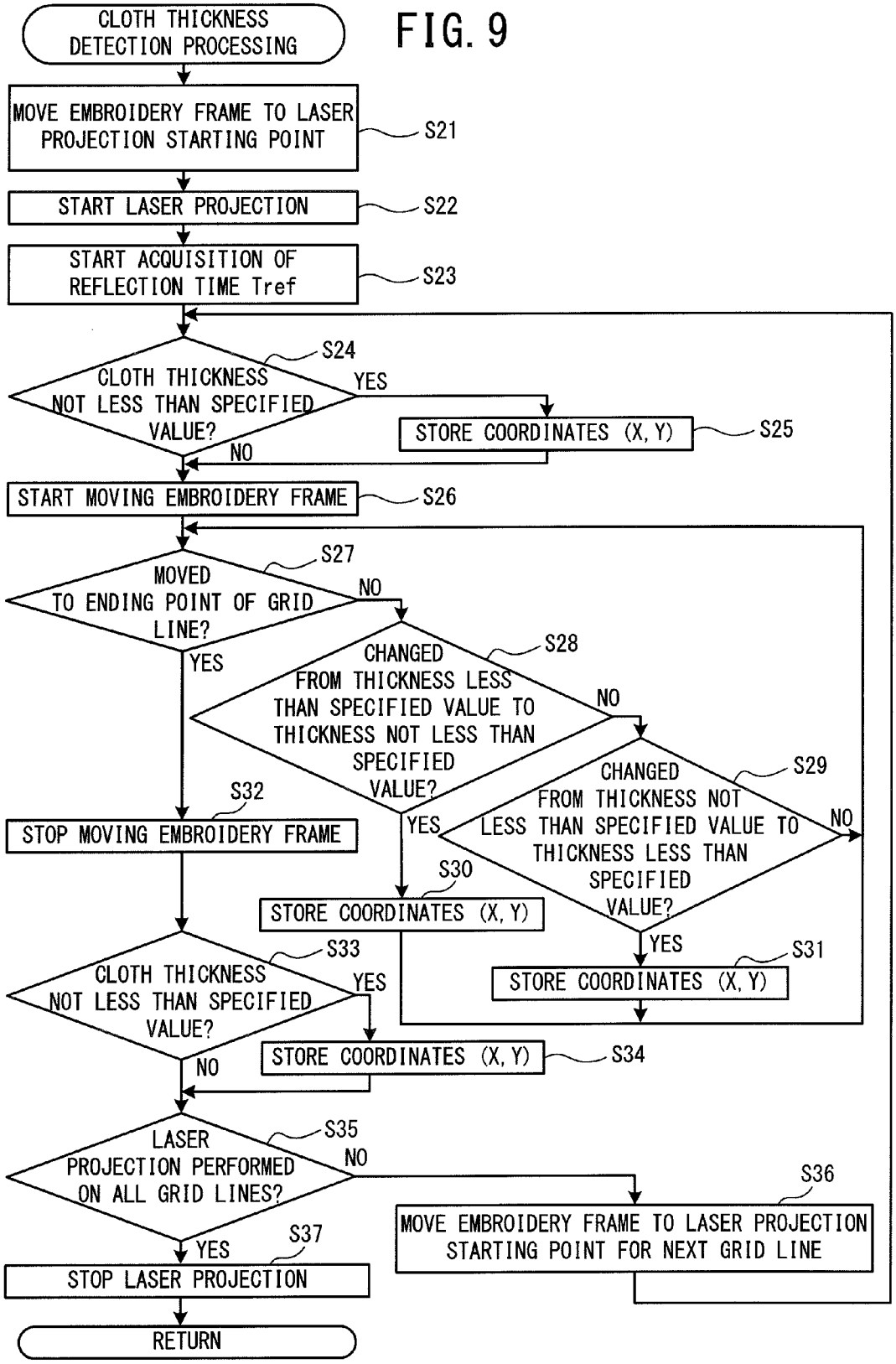
FIG. 9
CLOTH THICKNESS DETECTION PROCESSING
MOVE EMBROIDERY FRAME TO LASER PROJECTION STARTING POINT
S21
START LASER PROJECTION
S22
START ACQUISITION OF REFLECTION TIME Tref
S23
CLOTH THICKNESS NOT LESS THAN SPECIFIED VALUE?
S24
YES
NO
STORE COORDINATES (X, Y)
S25
START MOVING EMBROIDERY FRAME
S26
MOVED TO ENDING POINT OF GRID LINE?
S27
NO
YES
CHANGED FROM THICKNESS LESS THAN SPECIFIED VALUE TO THICKNESS NOT LESS THAN SPECIFIED VALUE?
S28
NO
YES
CHANGED FROM THICKNESS NOT LESS THAN SPECIFIED VALUE TO THICKNESS LESS THAN SPECIFIED VALUE?
S29
NO
YES
STOP MOVING EMBROIDERY FRAME
S32
STORE COORDINATES (X, Y)
S30
STORE COORDINATES (X, Y)
S31
CLOTH THICKNESS NOT LESS THAN SPECIFIED VALUE?
S33
YES
NO
STORE COORDINATES (X, Y)
S34
LASER PROJECTION PERFORMED ON ALL GRID LINES?
S35
NO
YES
MOVE EMBROIDERY FRAME TO LASER PROJECTION STARTING POINT FOR NEXT GRID LINE
S36
STOP LASER PROJECTION
S37
RETURN

FIG. 12

98

| NEEDLE DROP POINT NUMBER | NEEDLE DROP POINT | CUTTING EDGE DIRECTION |
|---|---|---|
| P1 | (0, 0) | 90° |
| P2 | (0, -2) | 90° |
| P3 | (0, -2) | 90° |
| P4 | (0, -2) | 90° |
| Q1 | (0, -1) | 90° |
| P5 | (0, -1) | 90° |
| Q2 | (0, -1) | 90° |
| P6 | (0, -1) | 90° |
| Q3 | (0, -1) | 90° |
| P7 | (0, -1) | 0° |
| Q4 | (1, 0) | 0° |
| P8 | (1, 0) | 0° |
| ⋮ | ⋮ | ⋮ |
| P32 | (-2, 0) | 0° |

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2013-231171, filed on Nov. 7, 2013, the content of which is hereby incorporated by reference.

BACKGROUND

The present disclosure relates to a sewing machine that is capable of cutting a work cloth with a cutting needle, and to a non-transitory computer-readable medium that stores a sewing machine control program.

A sewing machine on which a cutting needle can be mounted is known. The cutting needle is provided with a sharp cutting edge on its tip. The sewing machine cuts the work cloth by causing the cutting needle to pierce the work cloth repeatedly by moving a needle bar on which the cutting needle is mounted up and down.

For example, a sewing machine is known that is provided with a plurality of needle bars, and a cutter blade that is a cutting needle is mounted on each of two of the needle bars. The cutting edge of one of the cutter blades is formed such that it is oriented in a direction that is orthogonal to the direction in which the warp threads (the longitudinal threads) of the work cloth extend. The cutting edge of the other one of the cutter blades is formed such that it is oriented in a direction that is orthogonal to the direction in which the weft threads (the transverse threads) of the work cloth extend. The sewing machine cuts the longitudinal threads and the transverse threads of the work cloth by operating the individual needle bars while moving the work cloth.

SUMMARY

In known art, the work cloth is cut according to cut data in which the distances between successive needle drop points are fixed, irrespective of the thickness of the work cloth. However, in a work cloth with greater thickness, the fibers of the longitudinal threads and the transverse threads are thicker than in a work cloth with less thickness, and the density of the fibers of the longitudinal threads and the transverse threads is greater. Therefore, when a work cloth with greater thickness is cut, it sometimes happens that small numbers of the longitudinal threads and the transverse threads remain that cannot be cut, such that the work cloth is not reliably cut. Accordingly, in order to reliably cut a work cloth with greater thickness, consideration is given to setting all of the distances between successive needle drop points in the cut data to smaller values in advance. However, when the distances between successive needle drop points are made smaller, the number of the needle drop points in the cut data increases, so in a case where a work cloth with less thickness is cut according to the cut data, a problem occurs in that the cutting time becomes longer.

Various embodiments of the broad principles derived herein provide a sewing machine that is capable of modifying the distances between the successive needle drop points of a cutting needle in accordance with the thickness of the work cloth, and also provide a non-transitory computer-readable medium that stores a sewing machine control program.

Embodiments provide a sewing machine that includes a cloth thickness detection device, a storage device, and a control device. The cloth thickness detection device detects a cloth thickness of a work cloth. The storage device that stores cut data that include a plurality of needle drop points for a cutting needle. The control device modifies a distance between adjacent ones of the needle drop points in the cut data in accordance with the cloth thickness that has been detected by the cloth thickness detection device. Then, the storage device performs cut work on the work cloth using the cutting needle, in accordance with the cut data in which the distance between the adjacent needle drop points has been modified.

Embodiments also provide a non-transitory computer-readable medium storing computer-readable instructions that is executable on a sewing machine that includes a cloth thickness detection device. The computer-readable instructions, when executed, cause the sewing machine to perform processes that include detecting a cloth thickness of a work cloth. The detecting is performed by the cloth thickness detection device. The computer-readable instructions further cause the sewing machine to perform processes that include modifying a distance between adjacent ones of a plurality of needle drop points for a cutting needle, which are included in cut data, in accordance with the detected cloth thickness. The computer-readable instructions further cause the sewing machine to perform processes that include performing cut work on the work cloth using the cutting needle, in accordance with the cut data in which the distance between the adjacent needle drop points has been modified.

BRIEF DESCRIPTION OF THE DRAWINGS

Embodiments will be described below in detail with reference to the accompanying drawings in which:

FIG. 6 is a data configuration diagram of cut data 98 for cutting the cut pattern 70 that is shown in FIG. 5;

FIG. 9 is a flowchart of cloth thickness detection processing;

FIG. 12 is a data configuration diagram of the cut data 98, to which needle drop points have been added for cutting the cut pattern 70 that is shown in FIG. 11.

DETAILED DESCRIPTION

Hereinafter, an embodiment will be explained with reference to the drawings. Note that the drawings are used for explaining technological features that the present disclosure can utilize and do not serve to restrict the content of the present disclosure. A configuration of a multi-needle sewing machine (hereinafter simply called the sewing machine) 1 of the present embodiment will be explained with reference to FIGS. 1 to 3. The top side, the bottom side, the lower left side, the upper right side, the upper left side, and the lower right side in FIG. 1 respectively correspond to the top side, the bottom side, the front side, the rear side, the left side, and the right side of the sewing machine 1.

Figure 1:
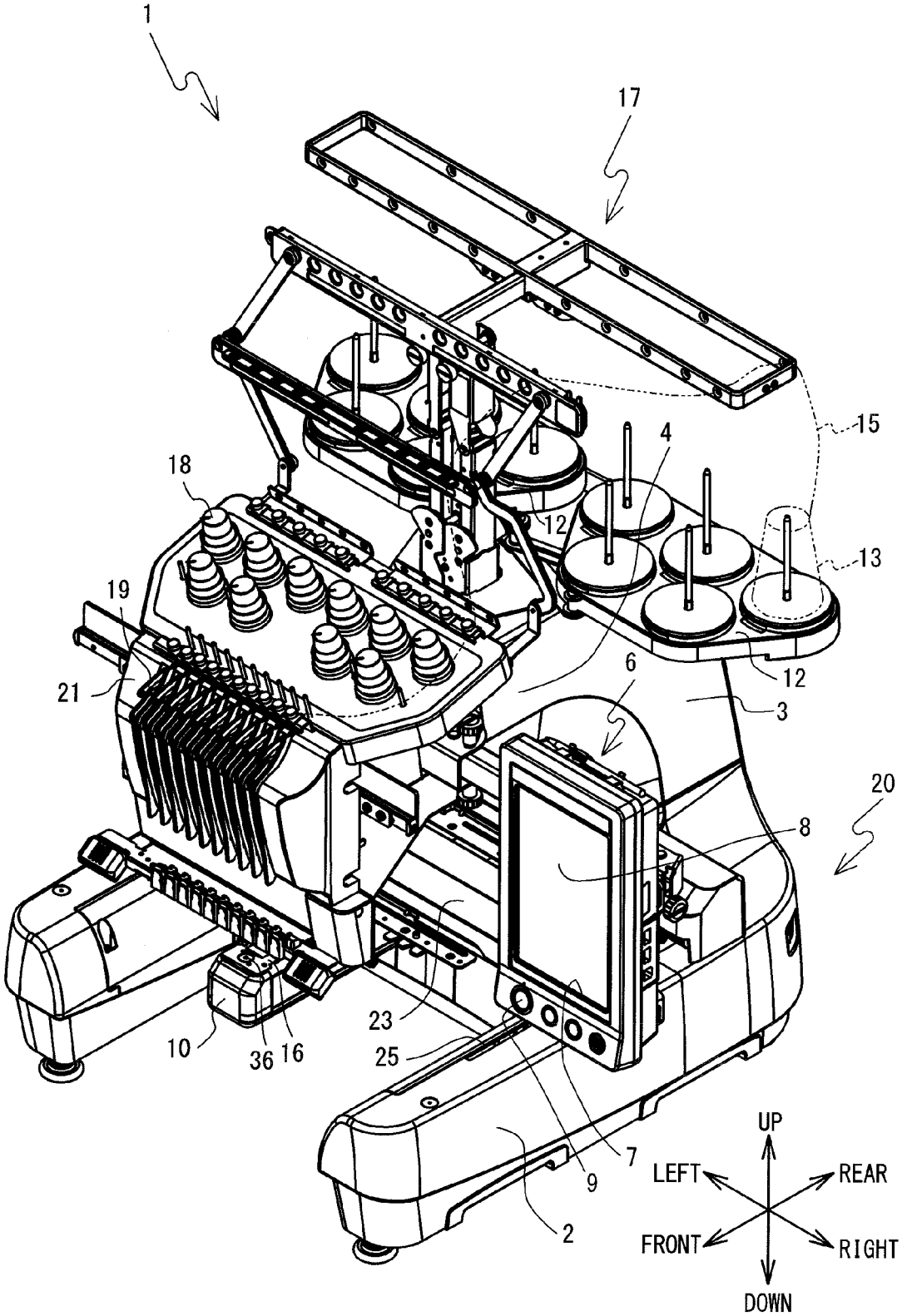
FIG. 1 is an oblique view of a sewing machine 1.

As shown in FIG. 1, a body 20 of the sewing machine 1 is mainly provided with a support portion 2, a pillar 3, and an arm 4. The support portion 2 is a base portion that is formed in an inverted U shape in a plan view. A left-right pair of guide slots 25 that extend in the front-rear direction are provided in the top face of the support portion 2. The pillar 3 is provided such that it extends upward from the rear edge of the support portion 2. The arm 4 extends toward the front from the upper end of the pillar 3. A needle bar case 21 that is able to move in the left-right direction is mounted on the front end of the arm 4. Ten needle bars 31 (refer to FIG. 2) that extend in the up-down direction are disposed at equal intervals in the left-right direction in the interior of the needle bar case 21. Among the ten needle bars 31, the one needle bar 31 that is in a sewing position is slid in the up-down direction by a needle bar drive mechanism 32 (refer to FIG. 4) that is provided in the interior of the needle bar case 21.

Figure 2:
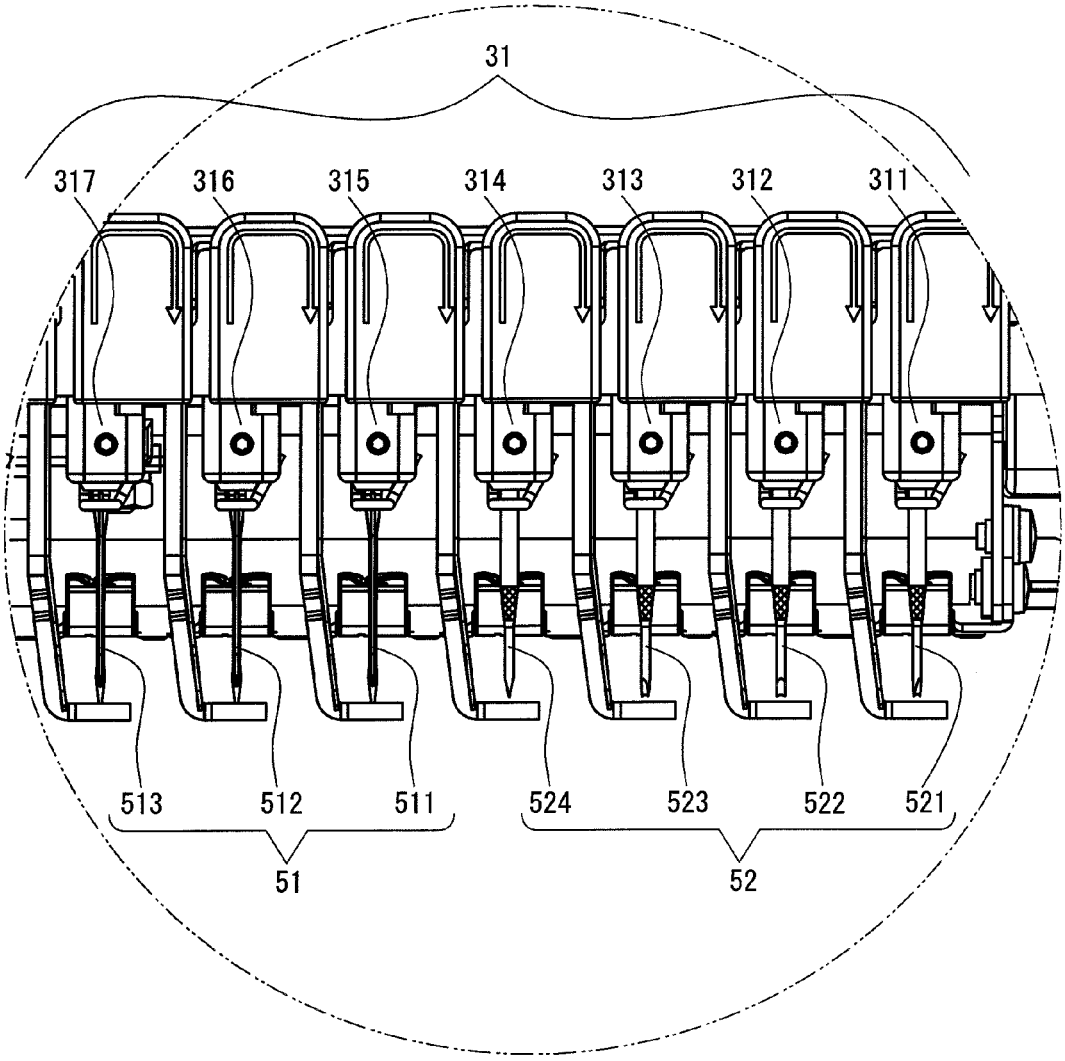
FIG. 2 is a partial front view of a lower edge portion of a needle bar case 21.

A sewing needle 51 and a cutting needle 52 will be explained with reference to FIG. 2. Note that, of the ten needle bars 31, FIG. 2 shows only the rightmost seven needle bars 31. One of the sewing needle 51 and the cutting needle 52 can be mounted on the lower end of each of the needle bars 31. FIG. 2 shows a state in which the sewing needles 51 (sewing needles 511, 512, 513) have been mounted on the fifth to the seventh needle bars 31 from the right (needle bars 315, 316, 317). The sewing machine 1 moves the sewing needle 51 that is in the sewing position reciprocally up and down repeatedly by sliding the needle bar 31 on which the sewing needle 51 is mounted up and down. The sewing machine 1 thus performs sewing on a work cloth 39 (refer to FIG. 3).

FIG. 2 shows a state in which the cutting needles 52 (cutting needles 521, 522, 523, 524) have been mounted on the first to the fourth needle bars 31 from the right (needle bars 311, 312, 313, 314). The cutting needles 52 are provided on their lower ends with cutting edges for forming cuts in the work cloth 39 (refer to FIG. 3). A shaft portion of the upper portion of the cutting needle 52 has a partially circular cylindrical shape with a flat surface on one side. The positional relationship between the direction in which the cutting edge is oriented and the flat surface that is formed on the shaft portion is different for each of the cutting needles 521 to 524. The cutting needle 52 can be mounted on the needle bar 31 in an orientation in which the flat surface on the shaft portion faces toward the rear of the sewing machine 1. Therefore, the plurality of the cutting needles 52 can be mounted in the sewing machine 1 in orientations in which each of the cutting edges is oriented in a different direction. Note that the direction in which the cutting edge is oriented is the direction in which the cutting edge extends at the time that the cutting needle 52 forms the cut in the work cloth 39.

A cloth thickness sensor 97 (refer to FIG. 4) that detects a cloth thickness is provided in a right portion of the lower edge of the needle bar case 21 that is shown in FIG. 1. The cloth thickness sensor 97 measures the cloth thickness by projecting a laser beam onto an area in the vicinity of a needle hole 36 (described later) in a needle plate 16 (described later) and measuring the time that is required for the reflected beam to be received (hereinafter called the reflection time).

An operation portion 6 is provided to the right of the central portion of the arm 4 in the front-rear direction. The operation portion 6 is provided with a liquid crystal display (hereinafter called the LCD) 7, a touch panel 8, and a start/stop switch 9. Based on image data, images are displayed on the LCD 7 that include various types of items, such as commands, illustrations, setting values, messages, and the like, for example. The touch panel 8 is provided on the front face of the LCD 7. A user can perform an operation of pressing on the touch panel 8 by using one of a finger and a touch pen. Hereinafter, this operation will be called a panel operation. The touch panel 8 detects the position that has been pressed by the one of the finger and the touch pen, and the sewing machine 1 (more specifically, a CPU 61 that will be described later) recognizes the item that corresponds to the detected position. In this way, the sewing machine 1 recognizes the item that has been selected. The user can use the panel operations to select an embroidery pattern, a cut pattern, a command that will be executed, and the like. The start/stop switch 9 is a switch for inputting commands that cause the sewing machine 1 to start and stop the sewing and the forming of the cuts.

A cylindrical cylinder bed 10 that extends toward the front from the lower end of the pillar 3 is provided below the arm 4. A shuttle (not shown in the drawings) is provided in the interior of the front end portion of the cylinder bed 10. The shuttle is able to contain a bobbin (not shown in the drawings), around which a lower thread (not shown in the drawings) is wound. A shuttle drive mechanism (not shown in the drawings) is provided in the interior of the cylinder bed 10. The shuttle drive mechanism (not shown in the drawings) rotationally drives the shuttle. The needle plate 16, which is rectangular in a plan view, is provided on the top face of the cylinder bed 10. The needle hole 36, through which the sewing needle 51 is able to pass, is provided in the needle plate 16.

As shown in FIG. 1, a left-right pair of thread spool holders 12 are provided on the rear side of the top face of the arm 4. Ten thread spools 13, the same number as the number of the needle bars 31, can be disposed on the pair of the thread spool holders 12. Upper threads 15 are supplied from the thread spools 13 that are disposed on the thread spool holders 12. Each of the upper threads 15 is supplied through a thread guide 17, a tensioner 18, a thread take-up lever 39, and the like to an eye (not shown in the drawings) of one of the sewing needles 51 that are mounted on the lower ends of the needle bars 31.

Figure 3:
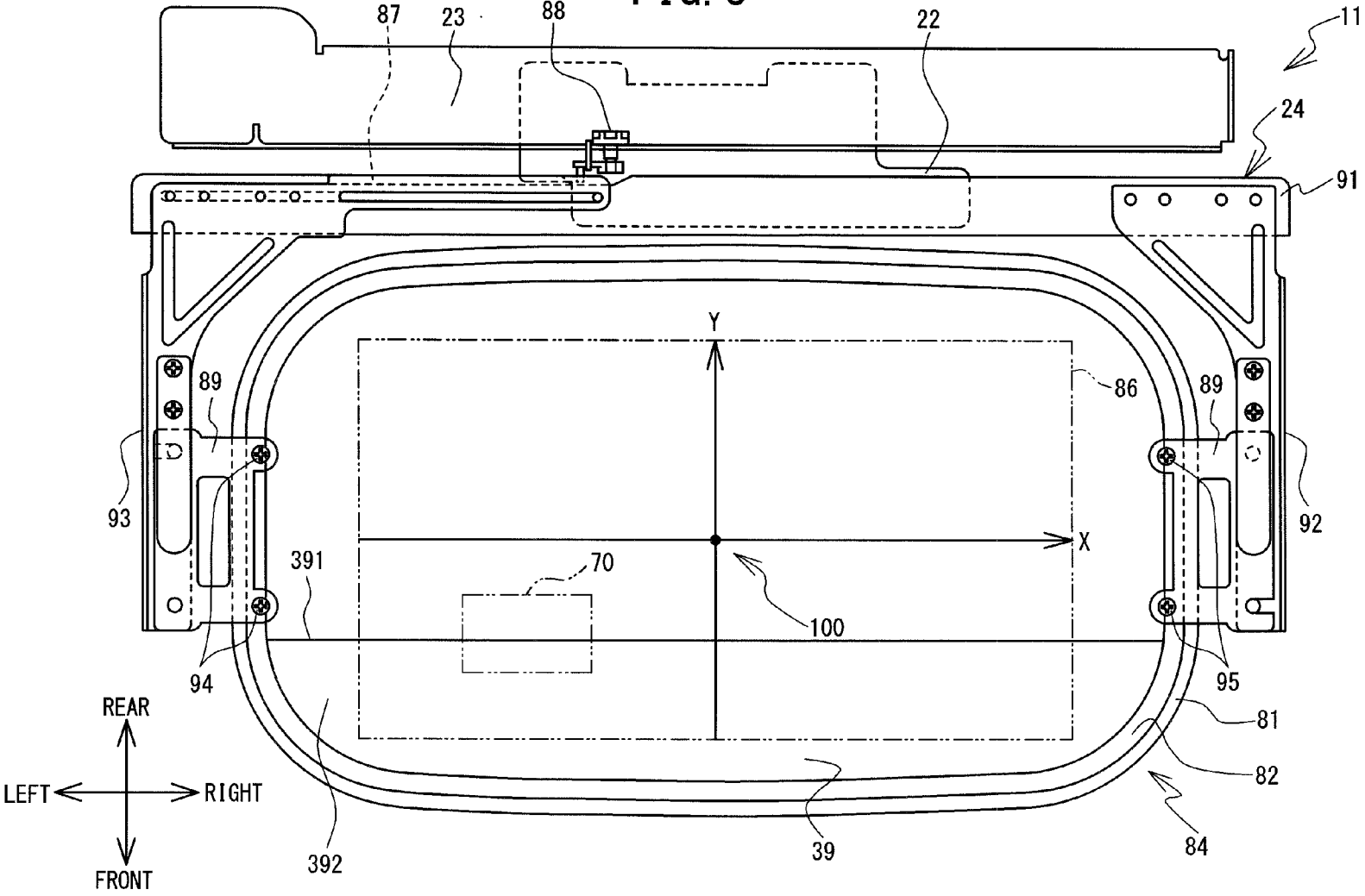
FIG. 3 is a plan view of an embroidery frame movement mechanism 11 in which an embroidery frame 84 is mounted.

A Y carriage 23 (refer to FIGS. 1 and 3) of an embroidery frame movement mechanism 11 (refer to FIG. 4) is provided below the arm 4. Various types of embroidery frames 84 (refer to FIG. 3) can be mounted on the embroidery frame movement mechanism 11. As shown in FIG. 3, the embroidery frame 84 holds the work cloth 39. The embroidery frame movement mechanism 11 moves the embroidery frame 84 in the front-rear and left-right directions using an X axis motor 132 (refer to FIG. 4) and a Y axis motor 134 (refer to FIG. 4) as drive sources.

The embroidery frame 84 and the embroidery frame movement mechanism 11 will be explained with reference to FIG. 3. The embroidery frame 84 is provided with an outer frame 81, an inner frame 82, and a left-right pair of coupling portions 89. The embroidery frame 84 clamps the work cloth 39 between the outer frame 81 and the inner frame 82. Each of the coupling portions 89 is a plate member that is rectangular in a plan view and that has a rectangular cut-out in its central portion. One of the coupling portions 89 is fastened by screws 95 to the right-hand portion of the inner frame 82. The other of the coupling portions 89 is fastened by screws 94 to the left-hand portion of the inner frame 82.

The embroidery frame movement mechanism 11 is provided with a holder 24, an X carriage 22, an X axis drive mechanism (not shown in the drawings), the Y carriage 23, a Y axis drive mechanism (not shown in the drawings), and a detecting device 88. The holder 24 supports the embroidery frame 84 such that the embroidery frame 84 can be mounted and removed. The holder 24 is provided with an attaching portion 91, a right arm portion 92, a left arm portion 93, and a detected portion 87. The attaching portion 91 is a plate member that is rectangular in a plan view, with its long sides extending in the left-right direction. The right arm portion 92 extends in the front-rear direction and is affixed to the right end of the attaching portion 91. The left arm portion 93 extends in the front-rear direction. The rear end portion of the left arm portion 93 is affixed to the left portion of the attaching portion 91 in a position that can be adjusted in the left-right direction in relation to the attaching portion 91. The right arm portion 92 is coupled to one of the coupling portions 89. The left arm portion 93 is coupled to the other of the coupling portions 89.

The distance between the coupling portions 89 differs according to the type of the embroidery frame that is held by the holder 24. After adjusting the position of the left arm portion 93 in the left-right direction according to the embroidery frame that will be used, the user fixes the left arm portion 93 in that position. The detected portion 87 is a long, thin, plate-shaped member that is provided in the left arm portion 93 and extends in the left-right direction. When the position of the left arm portion 93 in the left-right direction is adjusted, the detected portion 87 moves to the left and right as a single unit with the left arm portion 93. A plurality of step portions (not shown in the drawings) that come into contact with a detection element (not shown in the drawings) of the detecting device 88 that will be described later are formed in the detected portion 87. The height of each of the step portions is different, and the step portions are stair-shaped.

The detecting device 88 is affixed to the Y carriage 23. The detecting device 88 is a rotary potentiometer. The detection element is provided on a rotating shaft of the potentiometer, although this is not shown in detail in the drawings. A tip portion of the detection element comes into contact with one of the step portions of the detected portion 87 at a time, and the detecting device 88 outputs an electrical signal that varies according to the rotational angle of the detection element. The heights of the step portions of the detected portion 87 differ according to the position of the left arm portion 93 in the left-right direction in relation to the attaching portion 91, that is, according to the type of the embroidery frame 84. Therefore, the type of the embroidery frame 84 that is attached to the embroidery frame movement mechanism 11 can be specified based on the electrical signal that is output by the detecting device 88. The configurations of the detecting device 88 and the detected portion 87 that are described above are the same as those described in Japanese Laid-Open Patent Publication No. 2004-254987, so please refer to that Japanese Laid-Open Patent Publication for details.

The X carriage 22 is a plate member, with its long dimension extending in the left-right direction, and a portion of the X carriage 22 projects farther forward than does the front face of the Y carriage 23. The attaching portion 91 of the holder 24 is attached to the X carriage 22. The X axis drive mechanism (not shown in the drawings) is provided with a linear movement mechanism (not shown in the drawings). The linear movement mechanism is provided with a timing pulley (not shown in the drawings) and a timing belt (not shown in the drawings), and it moves the X carriage 22 in the left-right direction (the X axis direction) using the X axis motor 132 as its drive source.

The Y carriage 23 has a box shape, with its long dimension extending in the left-right direction. The Y carriage 23 supports the X carriage 22 such that the X carriage 22 can move in the left-right direction. The Y axis drive mechanism (not shown in the drawings) is provided with a pair of left and right moving bodies (not shown in the drawings) and a linear movement mechanism (not shown in the drawings). The moving bodies are coupled to the bottom portions of the left and right ends of the Y carriage 23 and pass vertically through the guide slots 25 (refer to FIG. 1). The linear movement mechanism is provided with a timing pulley (not shown in the drawings) and a timing belt (not shown in the drawings). Using the Y axis motor 134 as its drive source, the linear movement mechanism moves the moving bodies in the front-rear direction (the Y axis direction) along the guide slots 25. In conjunction with the movements of the moving bodies, the Y carriage 23, which is coupled to the moving bodies, and the X carriage 22, which is supported by the Y carriage 23, move in the front-rear direction (the Y axis direction). In a state in which the embroidery frame 84 that holds the work cloth 39 is mounted on the X carriage 22, the work cloth 39 is disposed between the needle bars 31 (refer to FIG. 2) and the needle plate 16 (refer to FIG. 1). Note that in the present embodiment, the thickness of the work cloth 39 that is held by the embroidery frame 84 is greater in the part of the work cloth 39 that is to the front of a boundary line 391 that extends in the left-right direction of the work cloth 39 than in the part that is to the rear of the boundary line 391. The thicker part to the front of the boundary line 391 will be called the thick region 392.

Figure 4:
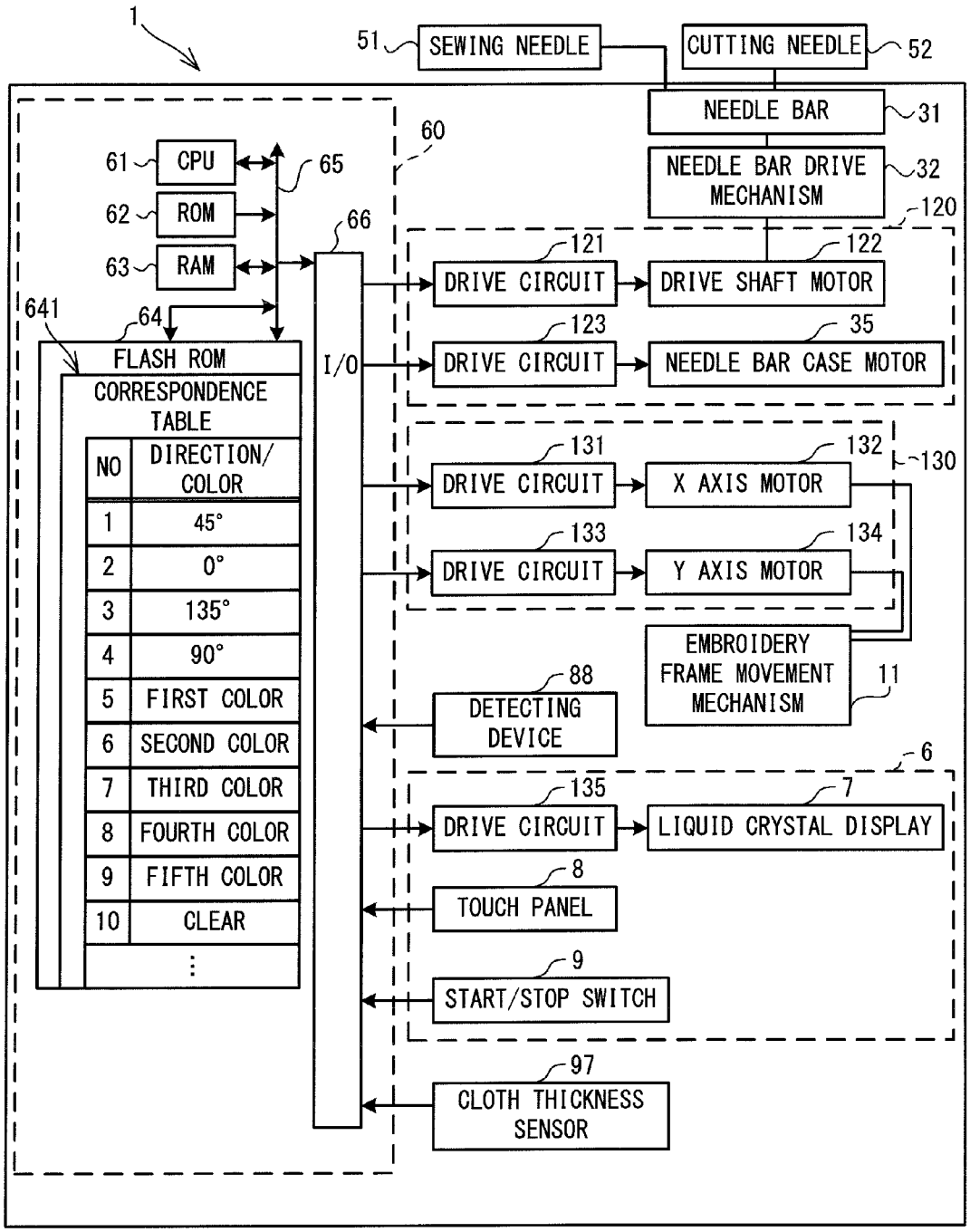
FIG. 4 is a block diagram of an electrical configuration of the sewing machine 1.

An electrical configuration of the sewing machine 1 will be explained with reference to FIG. 4. As shown in FIG. 4, the sewing machine 1 is provided with a sewing needle drive portion 120, a sewing workpiece drive portion 130, the operation portion 6, the detecting device 88, the cloth thickness sensor 97, and a control portion 60.

The sewing needle drive portion 120 is provided with a drive circuit 121, a drive shaft motor 122, a drive circuit 123, and a needle bar case motor 35. The drive circuit 121 drives the drive shaft motor 122 in accordance with a control signal from the control portion 60. By rotationally driving a drive shaft (not shown in the drawings), the drive shaft motor 122 drives the needle bar drive mechanism 32 to move the needle bar 31 that is in the sewing position up and down. One of the cutting needle 52 and the sewing needle 51 can be mounted on the needle bar 31. The drive circuit 123 drives the needle bar case motor 35 in accordance with a control signal from the control portion 60. The needle bar case motor 35 moves the needle bar case 21 (refer to FIG. 1) in the left-right direction by driving a movement mechanism that is not shown in the drawings.

The sewing workpiece drive portion 130 is provided with a drive circuit 131, the X axis motor 132, a drive circuit 133, and the Y axis motor 134. The drive circuit 131 drives the X axis motor 132 in accordance with a control signal from the control portion 60. The X axis motor 132 moves the embroidery frame 84 (refer to FIG. 3) in the left-right direction by driving the embroidery frame movement mechanism 11. The drive circuit 133 drives the Y axis motor 134 in accordance with a control signal from the control portion 60. The Y axis motor 134 moves the embroidery frame 84 in the front-rear direction by driving the embroidery frame movement mechanism 11.

The operation portion 6 is provided with a drive circuit 135, the LCD 7, the touch panel 8, and the start/stop switch 9. The drive circuit 135 drives the LCD 7 in accordance with a control signal from the control portion 60. The control portion 60 is provided with the CPU 61, a ROM 62, a RAM 63, a flash ROM 64, and an input/output interface (I/O) 66, which are connected to one another by a signal line 65. The sewing needle drive portion 120, the sewing workpiece drive portion 130, the operation portion 6, the detecting device 88, and the cloth thickness sensor 97 are each connected to the I/O 66.

The CPU 61 performs main control of the sewing machine 1 and, in accordance with various types of programs that are stored in a program storage area (not shown in the drawings) in the ROM 62, performs various types of computations and processing that have to do with sewing. The ROM 62 is provided with a plurality of storage areas that include the program storage area, although these are not shown in the drawings. Various types of programs for operating the sewing machine 1, including a cut work program, are stored in the program storage area. The cut work program is a program for performing cut work processing (described later) that forms specified cuts in the work cloth 39. Storage areas that store data such as computation results and the like from computational processing by the CPU 61 are provided in the RAM 63 as necessary. Various types of parameters for the sewing machine 1 to perform various types of processing, including a correspondence table 641, are stored in the flash ROM 64. The correspondence table 641 is a table in which each one of a plurality of needle bar numbers (in the "NO." column in FIG. 4) is stored in association with one of the direction of the cutting edge of the cutting needle 52 that is mounted on the needle bar 31 that is indicated by the needle bar number and the color of the thread that is being supplied to the sewing needle 51 that is mounted on the needle bar 31 that is indicated by the needle bar number. The needle bar numbers are numbers that are assigned to each one of the ten needle bars 31 to identify the needle bars 31, the needle bar numbers 1 to 10 being assigned in order starting from the right side.

In the present embodiment, the direction of the cutting edge is described by the angle, among the angles that are formed between the direction in which the cutting edge extends and a line segment that is parallel to the X axis, that is formed by rotating counterclockwise from the line segment that is parallel to the X axis. In the present embodiment, the directions of the cutting edges of the cutting needles 52 are zero degrees, 45 degrees, 90 degrees, and 135 degrees.

A cut pattern 70 and cut data 98 will be explained with reference to FIGS. 3, 5, and 6. The ROM 62 and the flash ROM 64 that are shown in FIG. 4 store pattern data that include sewing data for sewing a plurality of individual patterns, cut data for cutting a plurality of individual patterns, and the like. Using a panel operation, the user can select a desired pattern from among the plurality of the patterns that are described by the pattern data and can dispose the pattern in any desired position on the work cloth 39. It is also possible for the user to edit the desired pattern using a pattern editing function of the sewing machine 1, and to create pattern data for forming the pattern. As shown in FIG. 3, the cut pattern 70 is a pattern that is cut by the cutting needles 52, and it is rectangular, with its long axis extending in the left-right direction. In the example that is shown in FIG. 3, the cut pattern 70 is disposed such that it straddles the boundary line 391 of the work cloth 39, from the rear side of the boundary line 391 to the thick region 392.

An embroidery coordinate system 100 that is shown in FIG. 3 is a coordinate system for the X axis motor 132 that moves the X carriage 22 and for the Y axis motor 134. Coordinate data for the embroidery coordinate system 100 describe the position and the angle of the pattern in relation to a reference element (for example, the X carriage 22). The embroidery frame 84 that holds the work cloth 39 is mounted on the X carriage 22. Therefore, the coordinate data for the embroidery coordinate system 100 describe the position and the angle of the pattern in relation to the work cloth 39 that is held in the embroidery frame 84.

As shown in FIG. 3, in the embroidery coordinate system 100, the direction from left to right in the sewing machine 1 is the positive direction on the X axis, and the direction from front to rear in the sewing machine 1 is the positive direction on the Y axis. In the present embodiment, the initial position of the embroidery frame 84 is defined as the origin point (X, Y)=(0, 0) of the embroidery coordinate system 100. The initial position of the embroidery frame 84 is the position where the center point of a cut work-enabled area 86 that corresponds in size to the embroidery frame 84 is congruent with a needle drop point. The needle drop point is the point where the sewing needle 51 (or the cutting needle 52) that is disposed directly above the needle hole 36 (refer to FIG. 1) pierces the work cloth 39 when the needle bar 31 is moved downward toward the work cloth 39.

Figure 5:
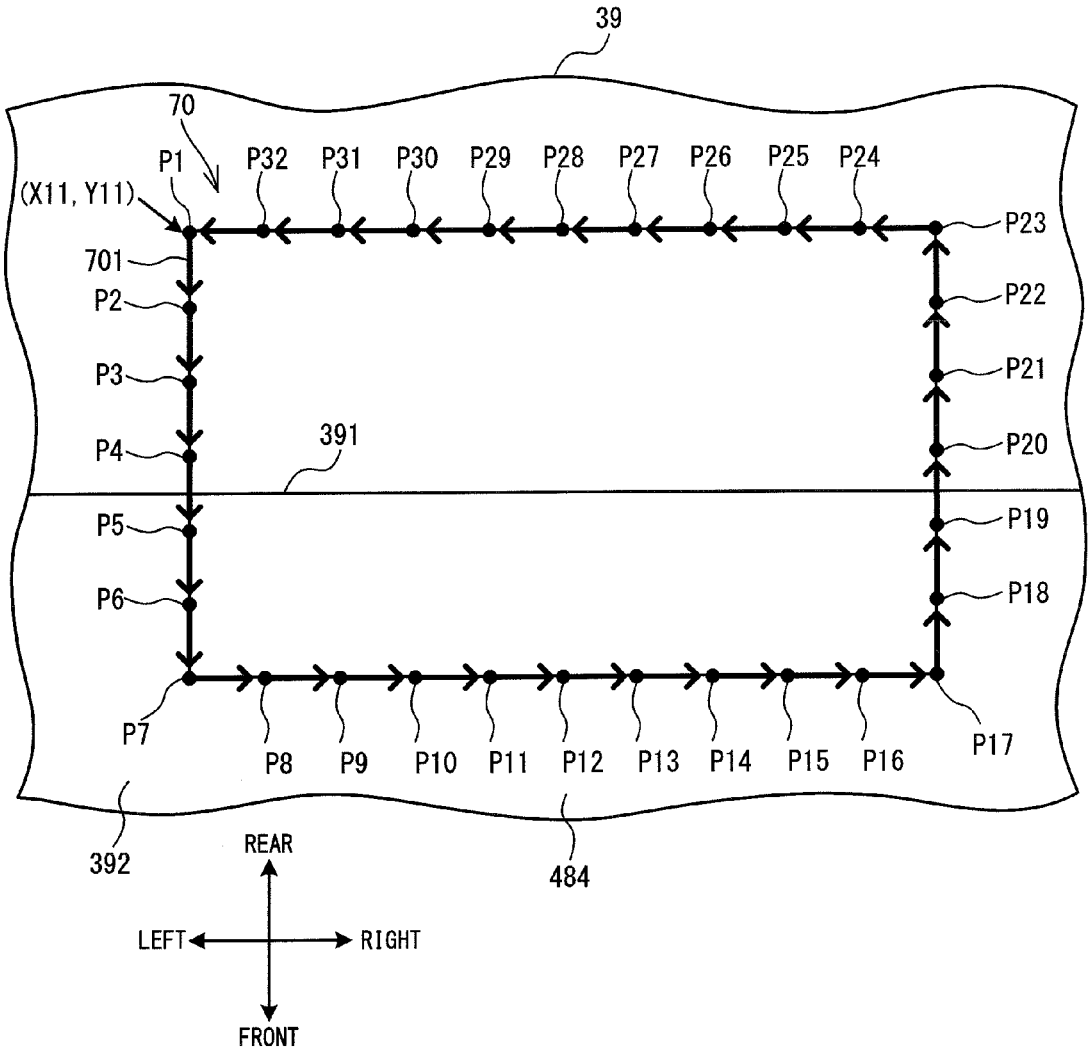
FIG. 5 is a plan view of a work cloth 39, showing needle drop points P1 to P32 and cuts in a case where a cut pattern 70 is cut.

FIG. 5 schematically shows the needle drop points and the cuts in a case where the cut pattern 70 is cut. Needle drop points P1 to P32 for the cut pattern 70 are shown as black dots. The lengths of the cuts that are formed when the cutting needle 52 pierces the work cloth 39 at the needle drop points P1 to P32 are indicated by arrows 701. In the explanation that follows, in a case where the needle drop points are referenced collectively and in a case where a specific needle drop point is not indicated, the needle drop points will be called the needle drop points P. In the present embodiment, the distances between successive needle drop points among the needle drop points P1 to P32 (hereinafter called the distances between successive needle drop points) are set to be equal to the widths of the cutting edges of the cutting needles 52, such as 2 millimeters, for example. In FIG. 5, in order to show the positions of the needle drop points P1 to P32 clearly, the lengths of the arrows 701 are drawn slightly shorter than the actual lengths, so that the arrows 701 will not overlap with the needle drop points P. However, the lengths of the arrows 701 are actually equal to the distance between the needle drop points P1 and P2, for example. Furthermore, the actual needle drop points are points in the centers of the arrows 701, but in FIG. 5, to facilitate the explanation, two successive needle drop points are shown as a point at the starting end and a point at the pointed end of the arrow 701.

As shown in FIG. 6, the cut data 98 associates each of the needle drop points with the direction of the cutting edge of the cutting needle 52 that pierces the work cloth 39 at that needle drop point. Note that in FIG. 6, needle drop point numbers are shown to facilitate the explanation, but it is acceptable for the needle drop point numbers not to be registered in the cut data 98. In the cut data 98, the first needle drop point P1 is set to (0, 0). Note that when the cut work is performed, the needle drop point P1 is modified in accordance with the position in which the cut pattern 70 is disposed. As shown in FIG. 5, the needle drop point P1 is the point at the upper left corner of the rectangular cut pattern 70. The subsequent needle drop points P2 to P32 are expressed in the form of amounts of movement in relation to the immediately preceding needle drop points. For example, the needle drop point P2 (0, −2) indicates that the needle drop point is in a position that is zero millimeters in the X axis direction and −2 millimeters in the Y axis direction from the needle drop point P1.

A cutting edge direction of 90 degrees is associated with the needle drop point P1. Therefore, when the cut work is performed, the cutting needle 524, whose cutting edge direction is 90 degrees, will pierce the work cloth 39 at the needle drop point P1. Accordingly, in FIG. 5, the cut at the needle drop point P1 that is expressed by the arrow 701 is formed in a direction that is 90 degrees from a line segment that is parallel to the X axis.

The cut work processing will be explained with reference to FIGS. 7 to 12. The cut work processing is performed in a case where the user has selected a pattern, then used a panel operation to input a start command. The program for performing the cut work processing is stored in the ROM 62 (refer to FIG. 4) and is executed by the CPU 61. Data that are acquired and computed in the process of the cut work processing are stored in the RAM 63 as necessary. A case in which the user has selected the cut pattern 70, disposed it in the embroidery coordinate system 100 as shown in FIG. 3, and then used a panel operation to input the start command will be explained as a specific example.

Figure 7:
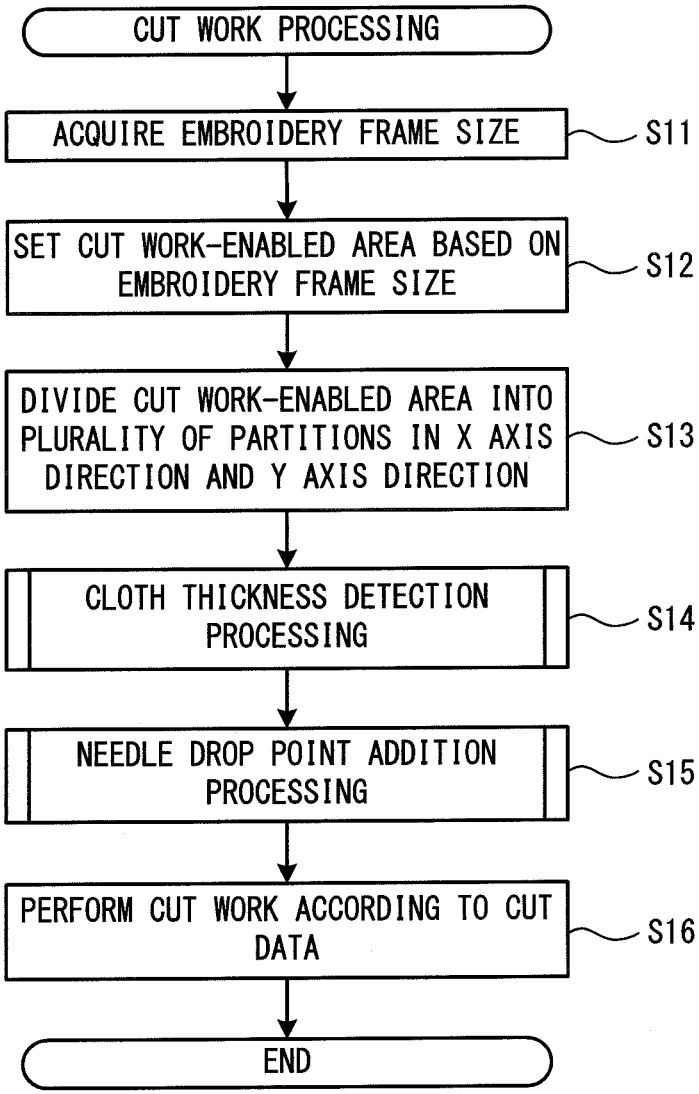
FIG. 7 is a flowchart of cut work processing.

As shown in FIG. 7, the CPU 61 specifies the type of the embroidery frame 84 that has been mounted on the embroidery frame movement mechanism 11, based on the electrical signal that is output by the detecting device 88, and acquires the size of the embroidery frame 84 (Step S11). Note that the size of the embroidery frame 84 is stored in one of the ROM 62 and the flash ROM 64. Based on the size of the embroidery frame 84 that was acquired at Step S11, the CPU 61 sets the cut work-enabled area 86 (refer to FIG. 3) (Step S12).

Figure 8:
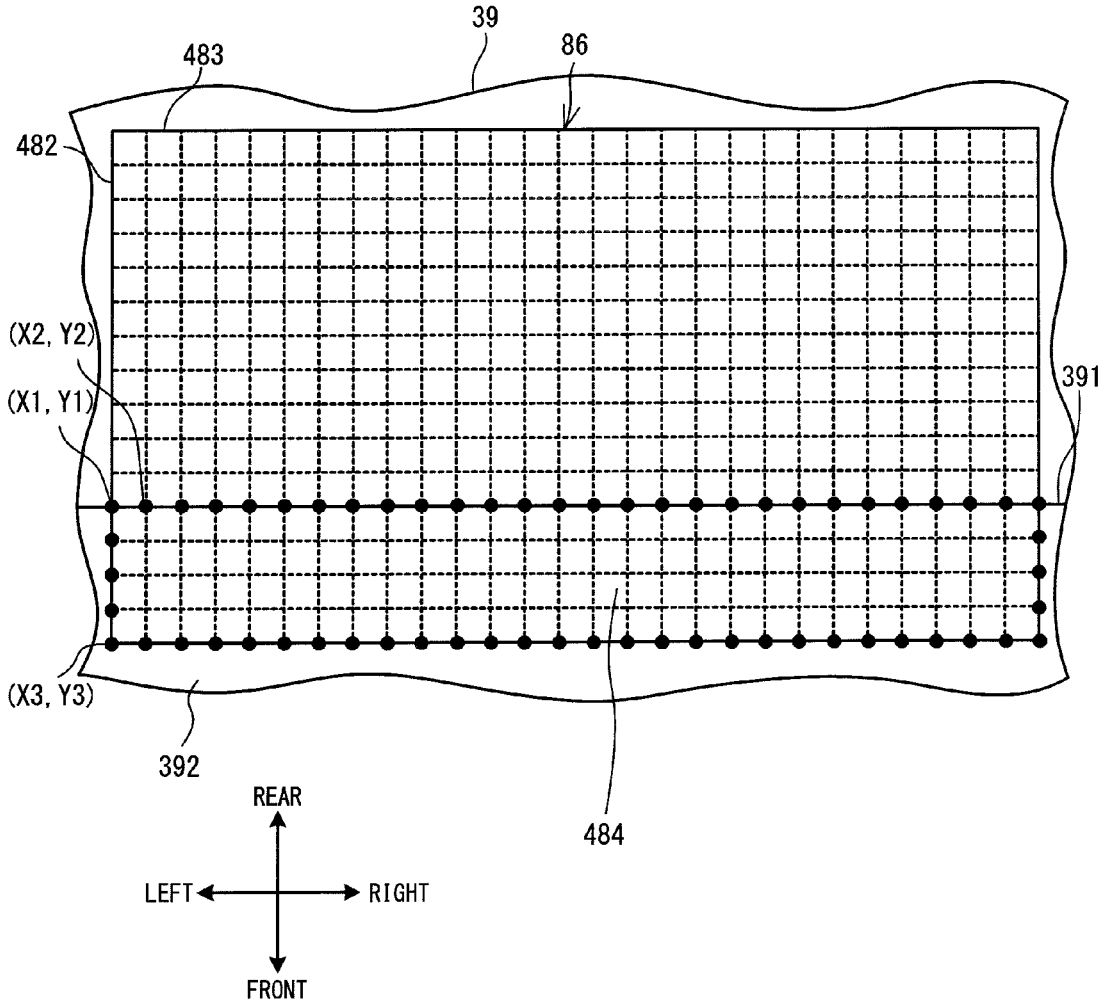
FIG. 8 is a plan view of the work cloth 39 for explaining a process that specifies a specified region 484.

Next, the CPU 61 divides the cut work-enabled area 86 into a plurality of partitions at specified intervals in the X axis direction (the left-right direction) and the Y axis direction (the front-rear direction), as shown in FIG. 8 (Step S13). The specified intervals may be one millimeter, for example, but in FIG. 8, the intervals are shown to be larger in order to facilitate the explanation. In the explanation that follows, the plurality of grid lines that partition the cut work-enabled area 86 along the X axis direction will be called the grid lines 482, and the plurality of grid lines that partition the cut work-enabled area 86 along the Y axis direction will be called the grid lines 483. Note that in FIG. 8, the reference numeral 482 is provided only for the leftmost of the grid lines 482, and the reference numeral 483 is provided only for the uppermost of the grid lines 483.

Next, the CPU 61 performs cloth thickness detection processing that detects the thickness of the work cloth 39 (Step S14). The cloth thickness detection processing will be explained with reference to FIG. 9. The cloth thickness detection processing is processing that detects the thickness of the work cloth 39 by sequentially projecting the laser beam from the cloth thickness sensor 97 onto the plurality of the grid lines 482, 483, then specifies a region where the cloth thickness is thicker than a specified value.

First, the CPU 61, by operating the embroidery frame movement mechanism 11, moves the embroidery frame 84 to a position where the laser beam that is projected from the cloth thickness sensor 97 can be projected onto a laser projection starting point (Step S21). In the present embodiment, as an example, first, the cloth thickness in the Y axis direction is detected along the leftmost grid line 482. Then the detecting of the cloth thickness in the Y axis direction is sequentially repeated until the cloth thickness is detected along the rightmost grid line 482. After the cloth thickness in the Y axis direction has been detected along the rightmost grid line 482, the cloth thickness in the X axis direction is detected along the uppermost grid line 483. Then the detecting of the cloth thickness in the X axis direction is sequentially repeated until the cloth thickness is detected along the lowermost grid line 483. In this case, the laser projection starting point is the rear end of the leftmost grid line 482.

The CPU 61 controls the cloth thickness sensor 97 to start the laser projection (Step S22). The CPU 61 starts acquiring a reflection time Tref for the reflected laser beam, which is acquired through the cloth thickness sensor 97 (Step S23). The CPU 61 determines whether the thickness of the work cloth 39 is not less than a specified value (for example, three millimeters) (Step S24). Note that in the present embodiment, the thick region 392 of the work cloth 39 is thicker than the specified value, and the part of the work cloth 39 that is to the rear of the boundary line 391 is thinner than the specified value. The CPU 61 also performs processing that compares the thickness of the work cloth 39 to the specified value at Steps S24, S28, S29, and S33, by comparing the reflection time Tref to a specified time Tthr that corresponds to the specified value. For example, in a case where the reflection time Tref is shorter than the specified time Tthr, the CPU 61 determines that the thickness of the work cloth 39 is not less than the specified value (YES at Step S24) and stores in the RAM 63 the coordinates (X, Y) where the laser beam was being projected at the time that the determination was made (Step S25). Next, the processing at Step S26, which will be described below, is performed.

In a case where the thickness of the work cloth 39 is less than the specified value (NO at Step S24), the CPU 61 moves the embroidery frame 84 (Step S26). More specifically, the CPU 61, by operating the embroidery frame movement mechanism 11, moves the embroidery frame 84 in one of the X axis direction and the Y axis direction, such that it becomes possible, at one of Steps S21 and S36 (described later), to project the laser beam along the one of the grid line 482 and the grid line 483 where the starting point is disposed (Step S26).

Next, the CPU 61 determines whether the embroidery frame 84 has been moved to a position where the laser beam can be projected onto the ending point of one of the grid line 482 and the grid line 483 (Step S27). In a case where the embroidery frame 84 has not been moved to a position where the laser beam can be projected onto the ending point (NO at Step S27), the CPU 61 determines whether the thickness of the work cloth 39 has changed from a thickness that is thinner than the specified value to a thickness that is not less than the specified value (Step S28). In a case where the thickness of the work cloth 39 has not changed from a thickness that is thinner than the specified value to a thickness that is not less than the specified value (NO at Step S28), the CPU 61 determines whether the thickness of the work cloth 39 has changed from a thickness that is not less than the specified value to a thickness that is thinner than the specified value (Step S29). In a case where the thickness of the work cloth 39 has not changed from a thickness that is not less than the specified value to a thickness that is thinner than the specified value (NO at Step S29), the CPU 61 returns the processing to Step S27.

For example, in a case where the laser beam is projected from the rear to the front along the leftmost grid line 482 that is shown in FIG. 8, when the laser beam is projected onto the coordinates (X1, Y1), which are on the boundary line 391, the CPU 61 determines that the thickness of the work cloth 39 has changed from a thickness that is thinner than the specified value to a thickness that is not less than the specified value (YES at Step S28). The CPU 61 then stores the coordinates (X1, Y1) in the RAM 63 (Step S30). Next, the CPU 61 returns the processing to Step S27. In the same manner, in a case where the laser beam is projected from the rear to the front along the second grid line 482 from the left in FIG. 8, when the laser beam is projected onto the coordinates (X2, Y2), which are on the boundary line 391, the CPU 61 determines that the thickness of the work cloth 39 has changed from a thickness that is thinner than the specified value to a thickness that is not less than the specified value (YES at Step S28). The CPU 61 then stores the coordinates (X2, Y2) in the RAM 63 (Step S30).

In a case where the thickness of the work cloth 39 has changed from a thickness that is not less than the specified value to a thickness that is thinner than the specified value (YES at Step S29), the CPU 61 stores the coordinates (X, Y) in the RAM 63 (Step S31). Next, the CPU 61 returns the processing to Step S27.

In a case where the embroidery frame 84 has been moved to a position where the laser beam can be projected onto the ending point of one of the grid line 482 and the grid line 483 (YES at Step S27), the CPU 61 stops operating the embroidery frame movement mechanism 11, thus stopping the movement of the embroidery frame 84 (Step S32). Next, the CPU 61 determines whether the thickness of the work cloth 39 is not less than the specified value (Step S33). In a case where the cloth thickness is less than the specified value (NO at Step S33), the CPU 61 performs Step S35, which will be described later.

For example, the cloth thickness at the coordinates (X3, Y3), which are at the ending point of the leftmost grid line 482, is not less than the specified value. Accordingly, the CPU 61 determines that the thickness of the work cloth 39 is not less than the specified value (YES at Step S33) and stores the coordinates (X3, Y3) in the RAM 63 (Step S34). Next, the CPU 61 determines whether the laser projection has been performed for all of the grid lines 482, 483 (Step S35). In a case where one of the grid lines 482 or the grid lines 483 remains for which the laser projection has not been performed (NO at Step S35), the CPU 61, by operating the embroidery frame movement mechanism 11, moves the embroidery frame 84 to a position where the laser beam can be projected onto the starting point of the next grid line 482 or the next grid line 483 (Step S36). Next, the CPU 61 returns the processing to Step S24.

By repeatedly performing the processing at Steps S24 to S36, the CPU 61 performs the laser projection along all of the grid lines 482, 483. By this process, the CPU 61 specifies, as a specified region 484, a region within the cut work-enabled area 86 where the cloth thickness is not less than the specified value. In the present embodiment, the CPU 61 specifies the specified region 484 by storing the coordinates of points on the perimeter of the specified region 484 (the coordinates of the points that are indicated by black dots in FIG. 8) (Steps S25, S30, S31, S34).

In a case where the laser projection has been performed for all of the grid lines 482, 483 (YES at Step S35), the CPU 61 stops the laser projection by the cloth thickness sensor 97 (Step S37). The CPU 61 terminates the cloth thickness detection processing and performs needle drop point addition processing (Step S15), as shown in FIG. 7.

The needle drop point addition processing will be explained with reference to FIG. 10. The needle drop point addition processing is processing that adds a needle drop point to the cut data 98 in a case where the needle drop point is in the specified region 484, where the cloth thickness is not less than the specified value. In the explanation that follows, a case in which a needle drop point is added to the cut data 98 that are shown in FIG. 6 will be explained as a specific example.

The CPU 61 sets a variable N to 1 (Step S41). The CPU 61 specifies an N-th needle drop point K in the cut data 98 (Step S42). Next, the CPU 61 specifies an N+1-th needle drop point Knext, which is the next needle drop point after the N-th needle drop point K, in the cut data 98 (Step S43). In the specific example, in a case where the variable N is 1, the needle drop point P1 (0, 0) that is shown in FIG. 6 is specified as the needle drop point K (Step S42), and the needle drop point P2 (0, −2) is specified as the needle drop point Knext (Step S43).

Next, the CPU 61 computes coordinates Cnext for the needle drop point Knext, based on the position where the cut pattern 70 is disposed (Step S44). The needle drop point K (0, 0) that was specified at Step S42 is the position that is indicated by the coordinates (X11, Y11) in FIG. 5. The coordinates Cnext for the needle drop point Knext are then computed by offsetting the needle drop point Knext (0, −2) from the coordinates (X11, Y11) (Step S44).

Next, the CPU 61 determines whether the coordinates Cnext that were computed at Step S44 are located within the specified region 484, where the cloth thickness is not less than the specified value (Step S45). In the specific example, in a case where the CPU 61 has determined that the coordinates Cnext are not located within the specified region 484 (NO at Step S45), the CPU 61 determines whether the needle drop point Knext is the last needle drop point in the cut data 98 (Step S48). In a case where the needle drop point Knext is not the last needle drop point (NO at Step S48), the CPU 61 adds 1 to the value of the variable N (Step S49). Next, the CPU 61 returns the processing to Step S42.

At Step S45, in a case where the coordinates Cnext are located within the specified region 484 (YES at Step S45), a determination is made as to whether the distance between the needle drop point K and the needle drop point Knext is not greater than the width of the cutting edge of the cutting needle 52 (Step S46). The width of the cutting edge of the cutting needle 52 is stored in the flash ROM 64 in advance. In a case where the distance between the needle drop point K and the needle drop point Knext is greater than the width of the cutting edge of the cutting needle 52 (NO at Step S46), the CPU 61 advances the processing to Step S48. In a case where the distance between the needle drop point K and the needle drop point Knext is greater than the width of the cutting edge of the cutting needle 52, the needle drop point K and the needle drop point Knext do not constitute a cut pattern in which successive cuts are formed between the needle drop point K and the needle drop point Knext. Therefore, the CPU 61 does not perform Step S47, which will be described later, and does not add a needle drop point to the cut data 98.

In a case where the distance between the needle drop point K and the needle drop point Knext is not greater than the width of the cutting edge of the cutting needle 52 (YES at Step S46), the CPU 61 adds to the cut data 98, as a new needle drop point, a dividing point for the amount of movement between the needle drop point K and the needle drop point Knext (Step S47). In the present embodiment, as an example, the dividing point is the midpoint between the needle drop point K and the needle drop point Knext. In a case where the CPU 61 adds the new needle drop point at Step S47, the CPU 61 also amends the cut data 98 such that the amount of movement to the next needle drop point after the newly added needle drop point will be the amount of movement from the newly added needle drop point.

Figure 11:
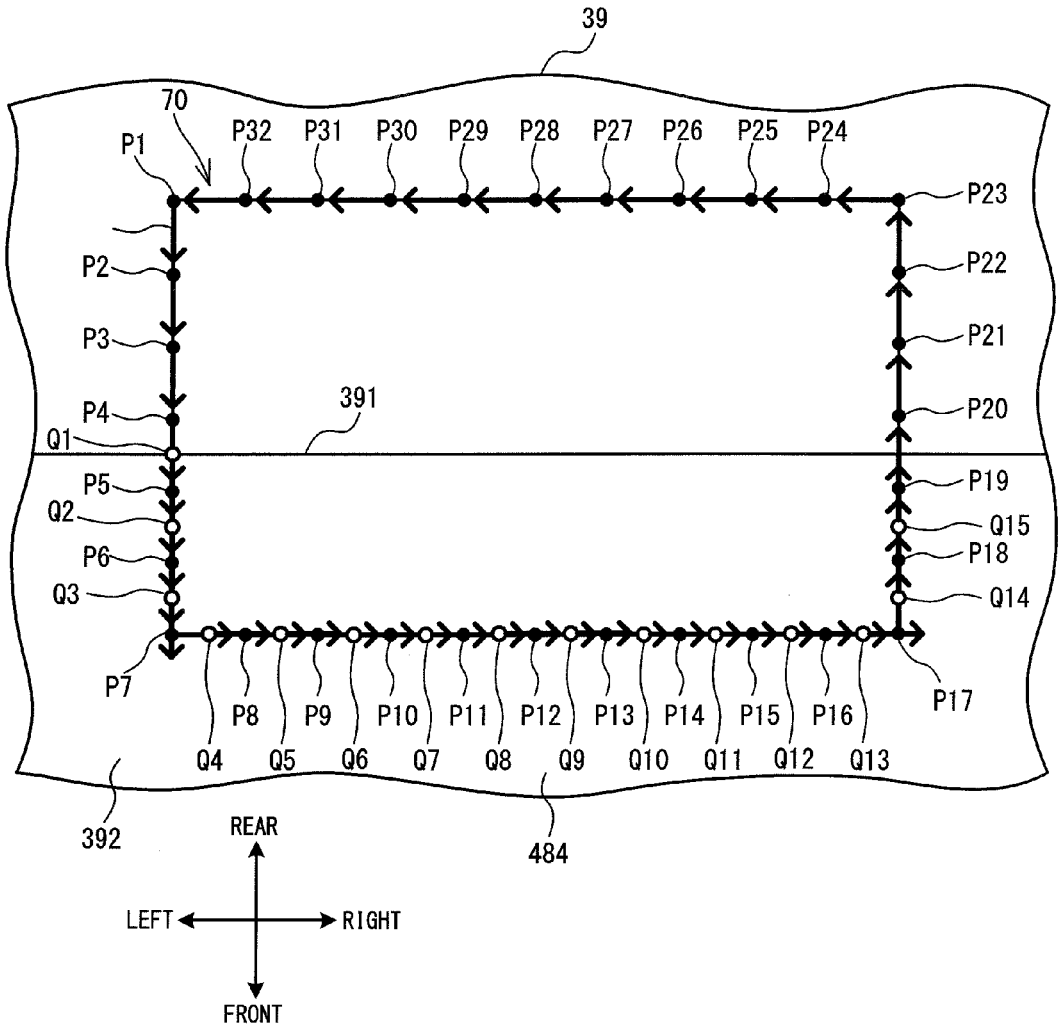
FIG. 11 is a plan view of the work cloth 39, showing needle drop points and cuts in a case where the cut pattern 70 is cut in a state in which needle drop points Q1 to Q15 have been added.

Specifically, the needle drop point P5 in FIG. 5 is located within the specified region 484. Therefore, when the needle drop point P5 is specified as the needle drop point Knext (Step S43), the determination is made that the coordinates Cnext are located inside the specified region 484 (YES at Step S45). Then the determination is made that the distance between the needle drop point K and the needle drop point Knext is not greater than the width of the cutting edge of the cutting needle 52 (YES at Step S46), and a needle drop point Q1 is added to the cut data 98, as shown in FIGS. 11 and 12. The needle drop point data for the needle drop point P5 in the cut data 98 are then amended from (0, −2), for which the needle drop point P4 that is shown in FIG. 6 is the reference, to (0, −1) for which the needle drop point Q1 that is shown in FIG. 12 is the reference. Next, the CPU 61 advances the processing to Step S48. By repeatedly performing the processing at Steps S41 to S49, the CPU 61 adds needle drop points Q2 to Q15 (refer to FIG. 11) to the cut data 98 (refer to FIG. 12). In this manner, the distances between successive needle drop points are modified.

In a case where the needle drop point Knext is the last needle drop point in the cut data 98 (YES at Step S48), the CPU 61 terminates the needle drop point addition processing. As shown in FIG. 7, the CPU 61 performs the cut work by the cutting needles 52 on the work cloth 39 (Step S16) according to the cut data 98 (refer to FIG. 12) in which the distances between successive needle drop points were modified at Step S47 (refer to FIG. 10). In this manner, the cut pattern 70 is cut as shown in FIG. 11. Next, the CPU 61 terminates the cut work processing.

The processing in the present embodiment is performed as described above. In the present embodiment, the thickness of the work cloth 39 that is detected by the cloth thickness sensor 97 is compared to the specified value (Steps S24, S28, S29, and S33 in FIG. 9), and the specified region 484, in which the cloth thickness is not less than the specified value, is specified (Steps S25, S30, S31, and S34). Then, in a case where the cloth thickness is not less than the specified value (YES at Step S45 in FIG. 10), the distance between successive needle drop points in the cut data 98 is reduced by adding a needle drop point (Step S47). Therefore, when the work cloth 39 is cut by the cutting needles 52, the possibility can be reduced that uncut longitudinal threads and transverse threads will remain in the portion of the work cloth 39 where the cloth thickness is greater than the specified value.

Furthermore, when the position of a needle drop point is modified from its initial value in the cut data 98, for example, the distances from the adjacent needle drop points change, so the positions of the adjacent needle drop points must also be modified such that they will be consistent with the changes in the distances. Accordingly, the processing that modifies the positions of the needle drop points sometimes becomes complicated. In the present embodiment, the distance between successive needle drop points can be shortened by adding a new needle drop point between the needle drop points (Step S47), without modifying the positions of the needle drop points from their initial values in the cut data 98, so the processing can be made simpler.

Furthermore, in the present embodiment, the dividing point for the amount of movement between the needle drop point K and the needle drop point Knext can be added to the cut data as a new needle drop point (Step S47). Moreover, the dividing point is the midpoint between the needle drop point K and the needle drop point Knext. Thus, in the present embodiment, the distance between successive needle drop points after the new needle drop point has been added is less than the width of the cutting edge of the cutting needle 52. In other words, in a case where the thickness of the work cloth 39 is not less than the specified value, the CPU 61, at Step S47, makes the distances between successive needle drop points in the cut data 98 smaller than the width of the cutting edge of the cutting needle 52. In that case, because the distances between the successive needle drop points are less than the width of the cutting edge, successive cuts will overlap when the work cloth 39 is cut by the cutting needle 52. The possibility that uncut longitudinal threads and transverse threads will remain in the portion of the work cloth 39 where the cloth thickness is greater than the specified value can therefore be reduced more reliably.

Figure 10:
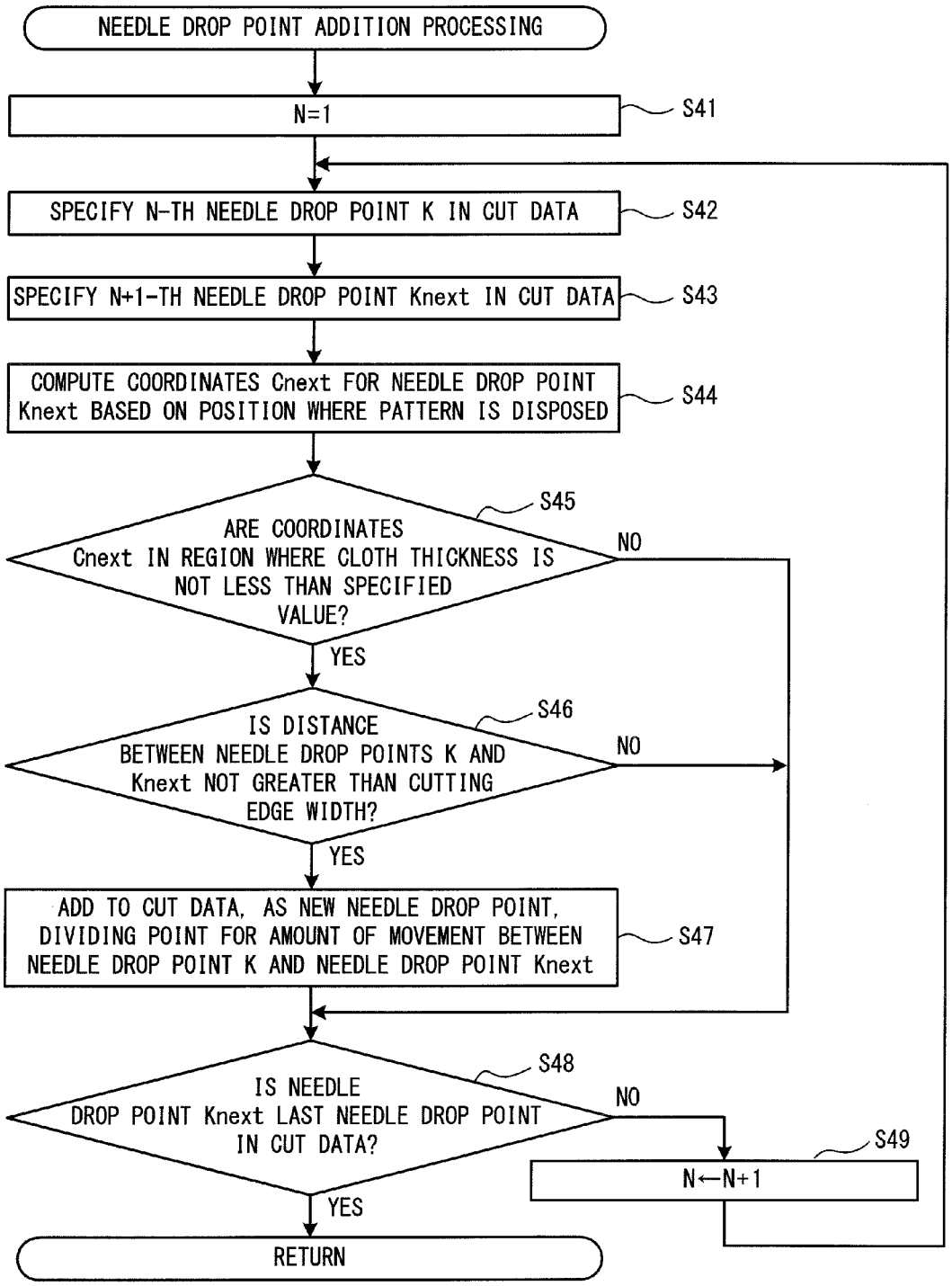
FIG. 10 is a flowchart of needle drop point addition processing.

Furthermore, in the present embodiment, the CPU 61 specifies the specified region 484, where the cloth thickness is not less than the specified value (Steps S25, S30, S31, S34 in FIG. 9), then determines whether the needle drop point is located inside the specified region 484 (Step S45 in FIG. 10). The distance between successive needle drop points can then be modified based on the result of that determination (Step S47). The operation of detecting the cloth thickness can therefore be performed continuously, so the processing can be made simpler than in a case where the needle drop point is specified and the operation of measuring the cloth thickness at the specified needle drop point is repeated for every needle drop point.

Note that the present disclosure is not limited to the embodiment that is described above, and various types of modifications can be made. For example, at Step S46, the determination with respect to the distance between the needle drop point K and the needle drop point Knext is made in relation to the width of the cutting edge of the cutting needle 52, but the standard for the determination at Step S46 is not limited to the width of the cutting edge. For example, the standard for the determination may be half of the width of the cutting edge and may also be a predetermined threshold value. It is also acceptable for the processing at Step S46 not to be performed.

Furthermore, at Step S47, when a needle drop point is added at the midpoint between successive needle drop points, the distance between successive needle drop points after the new needle drop point has been added to the cut data 98 is less than the width of the cutting edge of the cutting needle 52. However, the processing method in a case where the distance between successive needle drop points is made less than the width of the cutting edge of the cutting needle 52 is not limited to a method that is based on the distance between successive needle drop points. For example, the CPU 61 may also refer to the widths of the cutting needle 52 cutting edges that are stored in the flash ROM 64 and add a needle drop point based on the width of the cutting needle 52 cutting edge, such that the distance between successive needle drop points after the new needle drop point has been added is less than the width of the cutting edge.

The distance between successive needle drop points in the cut data 98 is modified by adding a new needle drop point between the needle drop points. However, the distance between the successive needle drop points in the cut data 98 may also be directly modified from its initial value, without the addition of a needle drop point.

The distance between successive needle drop points is also modified such that it becomes shorter in a case where the cloth thickness is thicker than the specified value (Step S47). However, the distance between successive needle drop points in the cut data 98 may also be modified according to the cloth thickness that is detected by the cloth thickness sensor 97. In a case where the cloth thickness is less than the specified value, for example, the distance between successive needle drop points may also be increased. In that case, the number of needle drop points would be reduced, so the time that is required in order to cut the work cloth 39 could be shortened.

In the present embodiment, the present disclosure is configured such that the cut work-enabled area 86 is set according to the type of the embroidery frame 84, but it may also be configured such that the user designates a desired area within the embroidery frame 84, and the designated area is set as the cut work-enabled area.

The sewing machine 1 of the present disclosure is a multi-needle sewing machine that is provided with the ten needle bars 31, but it may also be a sewing machine that is provided with one needle bar and is capable of performing embroidery sewing. In the present embodiment, the thickness of the work cloth 39 is detected using the cloth thickness sensor 97, which projects a laser beam, but the present disclosure is not limited to this configuration. For example, the present disclosure may also be configured such that it detects the thickness of the work cloth 39 based on the height of a presser foot that presses on the work cloth 39. More specifically, the presser foot would be mounted on the lower end of a presser bar, and the heights of the presser foot and the presser bar would vary according to variations in the thickness of the work cloth 39. Therefore, the present disclosure may also be configured such that it detects the cloth thickness by using a sensor to detect the height of the presser bar.

What is claimed is:

1. A sewing machine, comprising:

a cloth thickness detection device that is configured to detect a cloth thickness of a work cloth;

a storage device that stores cut data that includes a plurality of needle drop points for a cutting needle; and a control device that is operatively connected to the cloth thickness detection device and the storage device, and that is configured to modify a distance between adjacent ones of the needle drop points in the cut data in accordance with the cloth thickness that has been detected by the cloth thickness detection device and perform cut work on the work cloth using the cutting needle, in accordance with the cut data in which the distance between the adjacent needle drop points has been modified.

2. The sewing machine according to claim 1, wherein the control device is further configured to compare the detected cloth thickness of the work cloth to a specified value, and wherein the modifying of the distance between adjacent needle drop points by the control device comprises, in a case where the cloth thickness is not less than the specified value, modifying the distance between the adjacent needle drop points such that the distance between the adjacent needle drop points becomes shorter.

3. The sewing machine according to claim 2, wherein the modifying of the distance between the adjacent needle drop points by the control device comprises adding a new needle drop point between the adjacent needle drop points.

4. The sewing machine according to claim 2, wherein the modifying of the distance between the adjacent needle drop points by the control device comprises making the distance between the adjacent needle drop points shorter than a width of a cutting edge of the cutting needle.

5. The sewing machine according to claim 3, wherein the modifying of the distance between the adjacent needle drop points by the control device comprises making the distance between the adjacent needle drop points shorter than a width of a cutting edge of the cutting needle by adding the new needle drop point between the adjacent needle drop points.

6. The sewing machine according to claim 2, wherein the control device is further configured to specify a specified region based on the comparing of the detected cloth thickness of the work cloth to the specified value, the specified region being a region, within an area where the cut work is performed, where the cloth thickness is not less than the specified value, and determine whether the needle drop points that are included in the cut data are located within the specified region, and wherein the comparing of the detected cloth thickness of the work cloth to the specified value by the control device comprises comparing the detected cloth thickness of the work cloth in the area where the cut work is performed to the specified value, the cloth thickness of the work cloth in the area being detected by the cloth thickness detection device, and the modifying of the distance between the adjacent needle drop points by the control device comprises, in a case where the adjacent needle drop points are located within the specified region, modifying the distance between the adjacent needle drop points.

7. The sewing machine according to claim 6, wherein the modifying of the distance between the adjacent needle drop points by the control device comprises making the distance between the adjacent needle drop points shorter than a width of a cutting edge of the cutting needle by adding a new needle drop point between the adjacent needle drop points.

8. The sewing machine according to claim 1, wherein the control device is further configured to compare the detected cloth thickness of the work cloth to a specified value, and wherein the modifying of the distance between the adjacent needle drop points by the control device comprises, in a case where the cloth thickness is less than the specified value, modifying the distance between the adjacent needle drop points such that the distance between the adjacent needle drop points becomes longer.

9. A non-transitory computer-readable medium storing computer-readable instructions that are executable on a sewing machine that includes a cloth thickness detection device, a storage device, and a control device operatively connected to the cloth thickness detection device and the storage device, the instructions, when executed by the sewing machine, performing processes comprising:

detecting a cloth thickness of a work cloth, the detecting being performed by the cloth thickness detection device;

modifying, with the control device, a distance between adjacent ones of a plurality of needle drop points for a cutting needle, which are included in cut data stored in the storage device, in accordance with the detected cloth thickness; and performing cut work on the work cloth using the cutting needle, in accordance with the cut data in which the distance between the adjacent needle drop points has been modified.

* * * * *